United States Patent [19]

Ryan

[11] Patent Number: 4,527,372

[45] Date of Patent: Jul. 9, 1985

[54] HIGH PERFORMANCE COMPOSITE FLOOR STRUCTURE

[75] Inventor: Thomas G. Ryan, Bethel Park, Pa.

[73] Assignee: Cyclops Corporation, Pittsburgh, Pa.

[21] Appl. No.: 488,795

[22] Filed: Apr. 26, 1983

[51] Int. Cl.[3] ..... E04B 1/24; E04B 5/19

[52] U.S. Cl. ..... 52/334; 52/733

[58] Field of Search ..... 52/334–336, 52/450, 630, 329, 773

[56] References Cited

U.S. PATENT DOCUMENTS

| | | | |
|---|---|---|---|
| 1,550,810 | 8/1925 | Jabelonsky | 52/329 |
| 1,703,113 | 2/1929 | Lally | 52/329 |
| 2,110,235 | 3/1938 | Neeld . | |
| 3,094,813 | 6/1963 | Saxe . | |
| 3,110,049 | 11/1963 | Nagin . | |
| 3,256,667 | 6/1966 | Jungbluth et al. | 52/630 |
| 3,392,499 | 7/1968 | McManus . | |
| 3,527,007 | 9/1970 | McManus . | |
| 3,624,980 | 2/1970 | McManus . | |
| 3,720,029 | 3/1973 | Curran | 52/336 |
| 3,967,426 | 7/1976 | Ault et al. . | |
| 4,144,369 | 3/1979 | Wass | 52/450 |

OTHER PUBLICATIONS

Nippon Kokan Light Steel Kabushikikaisha "Deck Plate" Catalog-Enclosed Deck Plate-p. 11.

*Primary Examiner*—James L. Ridgill, Jr.

*Attorney, Agent, or Firm*—Buell, Ziesenhiem, Beck & Alstadt

[57] ABSTRACT

A composite floor structure is disclosed in which a plurality of corrugated sheets having crest portions which slope downwardly at each end thereof are supported on the top surface of a plurality of spaced I-section supporting beams. Studs are welded directly to the top surface of the I-beams directly over the beam's webbing to securely connect the beams to an overlying concrete slab, thereby creating a composite action between the beam and slab and increasing the load carrying ability of the I-beams. By providing a sufficient volume of concrete around the studs, each stud is completely effective. Embossments may be provided in the sheets to also create a composite action between the sheets and the slab causing the entire structure to act as a single composite unit to resist vertical gravity loads (bending) and in plane horizontal wind or seismic loads (shear).

4 Claims, 5 Drawing Figures

HIGH PERFORMANCE COMPOSITE FLOOR STRUCTURE

This invention relates to a new and improved composite floor structure. More specifically, corrugated metal sheets having sloping closed end crest portions are supported on the outside edges of the top surface of spaced I-section beams. Studs are attached to the center of the exposed top surface of each I-beam directly over the web portion of the beams. Preferably, embossments are provided on the web portions in the sheets to aid in securing them to a concrete slab which is poured over the beams and sheets. As a result of this arrangment of elements, the beams, sheets and slab act as a single composite structure. Additionally, the position of the studs in line with the web of the I-beam raises the bending moment of the beam making it functionally equivalent to a much larger beam.

It is well-known in the art to provide a composite floor structure having a corrugated metal sheet supported on beams. Those flooring systems typically provide a composite action between the overlying concrete slab and the corrugated sheet. It is also desired to provide a composite action between the concrete slab and the supporting beams. In order to provide this type of composite action, however, there must be a way to connect the supporting beams to the concrete slab. In most known structures, the corrugated sheet completely covers the supporting beams requiring studs to be welded to the beams through the valley portions of the sheet itself. The obvious short-comings of that arrangement are that studs may only be placed where there is a valley, which may not allow an adequate volume of concrete to surround the stud for development of full shear capacity, and that the studs are not as secure as studs welded directly to the beam. In some cases the galvanized coating or the parent steel thickness may even prohibit the welding of studs through the sheet. As a result of these limitations, many additional studs are often required, which in some instances still results in some diminuation of the composite action and overall strength of the structure.

It is also known that the above-mentioned problems may be eliminated by terminating the sheets where they cross over the supporting I-beams and providing covers for the crest portions of the corrugated sheets. With that arrangement, studs can be welded directly to the support beams. Unfortunately, that solution also creates two additional problems. First, providing covers for the crest portions of the sheets to prevent the unwanted flow of concrete is a time consuming and costly process. Second, only a very narrow rectangular channel located over the central portion of the beam is available to receive studs since the terminated sheets having vertically oriented covers must necessarily be supported by the edge of the beam. Therefore, although studs can be welded directly to the beam they are only partially effective because there is an insufficient volume of concrete surrounding them. The sheets, having covers attached over the crest portions and supported on the beams, restrict the volume of concrete which can surround each stud, thereby reducing its effectiveness.

Recently, a formed corrugated sheet has been made available wherein the ends of each crest are sloped so as to close each crest. At the points where the slope meets the level of the valley, a lip is provided to permit easy placement of the sheet on support beams. Those sheets, however, are typically provided only as concrete forms to prevent unwanted flow of concrete and would not be suitable for use as a component of the present invention since the lip extends far beyond the point where the crest is terminated. When the sheet is placed on supporting beams, the lip covers much of the top of the beam and would, therefore, interfere with the placement of the studs and the flow of concrete around any studs attached to the beam.

In addition to the shortcomings of the deck sheets discussed above, the prior art has not appreciated the importance of stud location. Specifically, the art has not recognized that placement of studs in line with the web of an I-beam will greatly improve the strength of a composite beam.

The present invention effectively combines the benefits of two distinct types of flooring structures. First, I provide a structure which utilizes a corrugated metal sheet attached to a concrete slab. The composite action of the sheet and the concrete provides greater strength and flexibility than a concrete slab could have alone.

Second, the present invention provides a means to effectively secure the concrete slab directly over an exposed I-beam, thereby creating a composite action between the concrete and the beam. This, in effect, increases the overall load carrying potential of the structure just as if a larger I-beam had been used in the first instance.

Unlike other known flooring structures, the shape and configuration of the corrugated sheets utilized in my flooring structure does not result in any loss of effectiveness or interfere in any way with securing the slab to the beam. Additionally, the imparted sloping closed end crests provided in the corrugated sheets allows for the formation of a continuous concrete channel or haunch which completely surrounds the studs to provide effective shear capacity of the studs. This concrete channel or haunch maximizes the shear capacity of each stud at its base allowing shorter studs to be utilized. Other systems which require the corrugated sheet to cross over the I-beam and the studs to be welded through the sheet must utilize studs extending above the sheets to develop greater shears. Further, the formed concrete channel or haunch provides additional effective concrete because it is continuous. Ideally, this additional concrete is provided adjacent to the top surface of the I-beam.

By combining the above-mentioned features, the present invention effectively provides composite action between the supporting beams, the concrete slab and the corrugated sheet producing a high performance flooring structure which offers greater resistance to both vertical gravity loads (bending) and in plane horizontal wind or seismic loads (shear). Because of the increased strength the structure provides, the user is given the option of reducing the thickness of the I-beam without loss of strength or of increasing the floor's strength by providing a beam of standard thickness. The present invention may even be utilized to add a degree of safety to structures built in high wind or earthquake prone regions.

I provide an improved composite flooring structure comprising a corrugated sheet, spaced supporting I-beams, a plurality of studs and an attached overlying concrete slab in which the studs are welded directly to the top surface of the supporting I-beams. I weld the studs in the center of the beams directly over the beam's vertically disposed web to maximize the composite action of the beam and the slab. The structure I provide allows for sufficient space surrounding the studs so that each stud is completely effective. To accomplish this, I provide a corrugated sheet having crest portions which slope downwardly at each end thereof to close the cells. I prefer to provide sheets in which the crest ends slope downwardly at a forty-five degree angle (one hundred and thirty-five degrees with respect to a body portion of the crests). However, any obtuse angle, preferably in the range of one hundred and twenty to one hundred and fifty degrees with respect to a body portion of the crest will work.

The sheet I provide does not extend far beyond the point where the cells are closed, but rather terminates at or near that point.

I prefer to provide a sheet having rigid ends so that it may be supported on a relatively small portion of the top of the spaced supporting beams, thereby leaving the major portion of the beam exposed to receive concrete which will surround the studs.

I prefer to provide additional, shallow corrugations in the crest portions of the sheet to increase the rigidity of the sheet.

I further prefer to provide embossments on the corrugated sheet to secure it to the overlying slab.

The operation and additional advantages of the present invention will be more fully understood from the following description of the invention and reference to the accompanying drawings in which.

Figure 1:
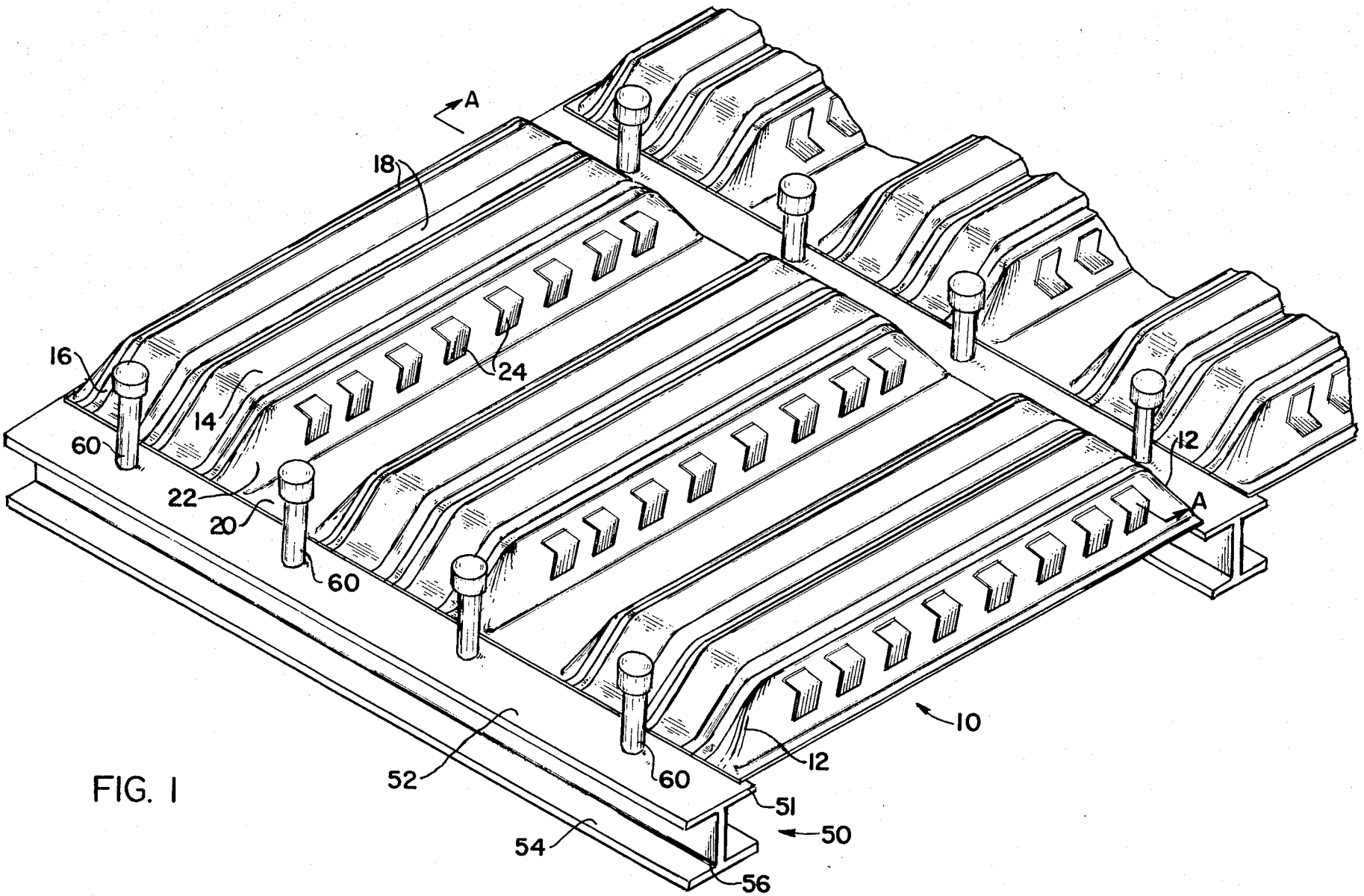
FIG. 1 is an isometric view of the flooring structure showing the corrugated sheets as supported on the beams and the studs as welded to the beams.

Referring specifically to the drawings, a corrugated metal sheet 10 is shown as supported at each end 12 thereof on two spaced supporting I-section beams 50. Each beam 50 has a top member 52, base member 54 and an intermediate vertically oriented web member 56. I prefer to provide sheets 10 having relatively rigid end portions 12 so that the sheets may be adequately supported by a narrow edge portion 51 of the top 52 of beam 50. In this way, a substantial portion of the top member 52 of beam 50 including the entire area directly above web member 56 remains exposed so that the studs 60 can be welded directly to the beam 50 at any point along or near a longitudinal center line thereof directly over web 56 rather than indirectly welded through sheet 10. Direct welding of the studs to the beam provides a more secure connection.

Figure 2:
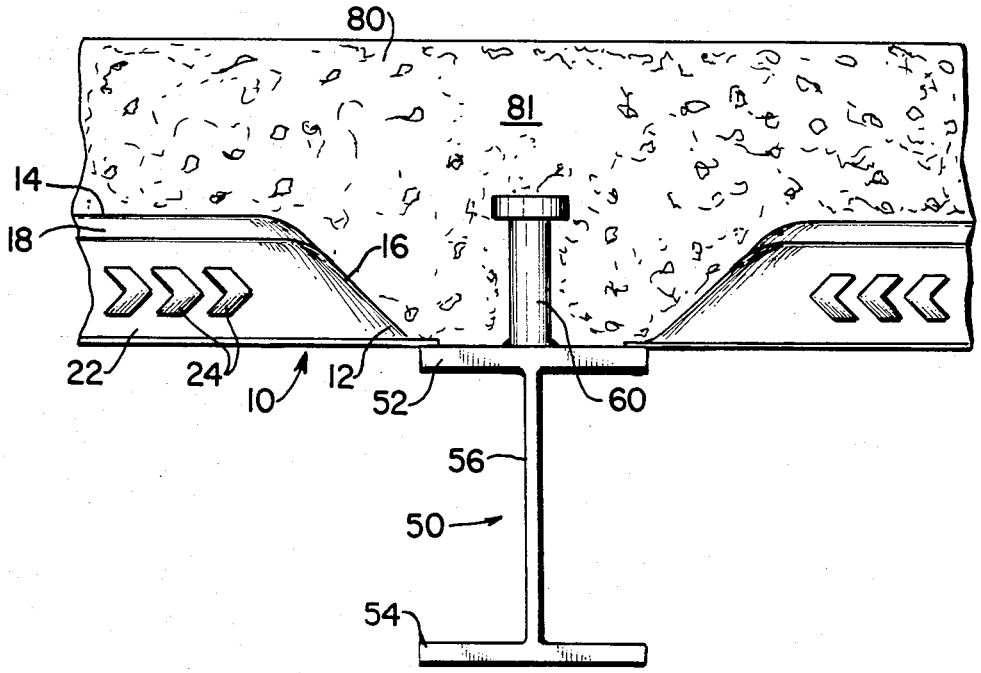
FIG. 2 is a side elevational view of a portion of the structure shown in FIG. 1 also showing a concrete slab.
Figure 3:
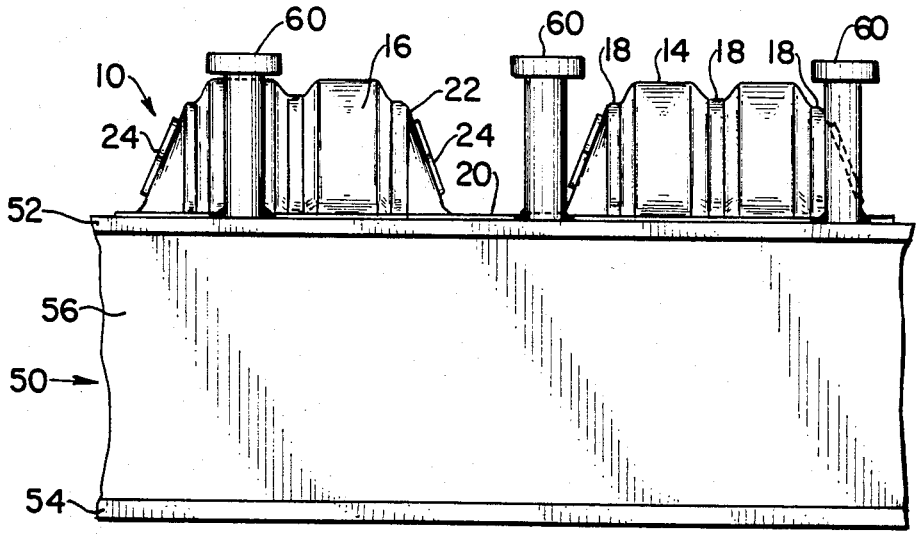
FIG. 3 is an end elevational view of a portion of the structure shown in FIG. 1.
Figure 4:
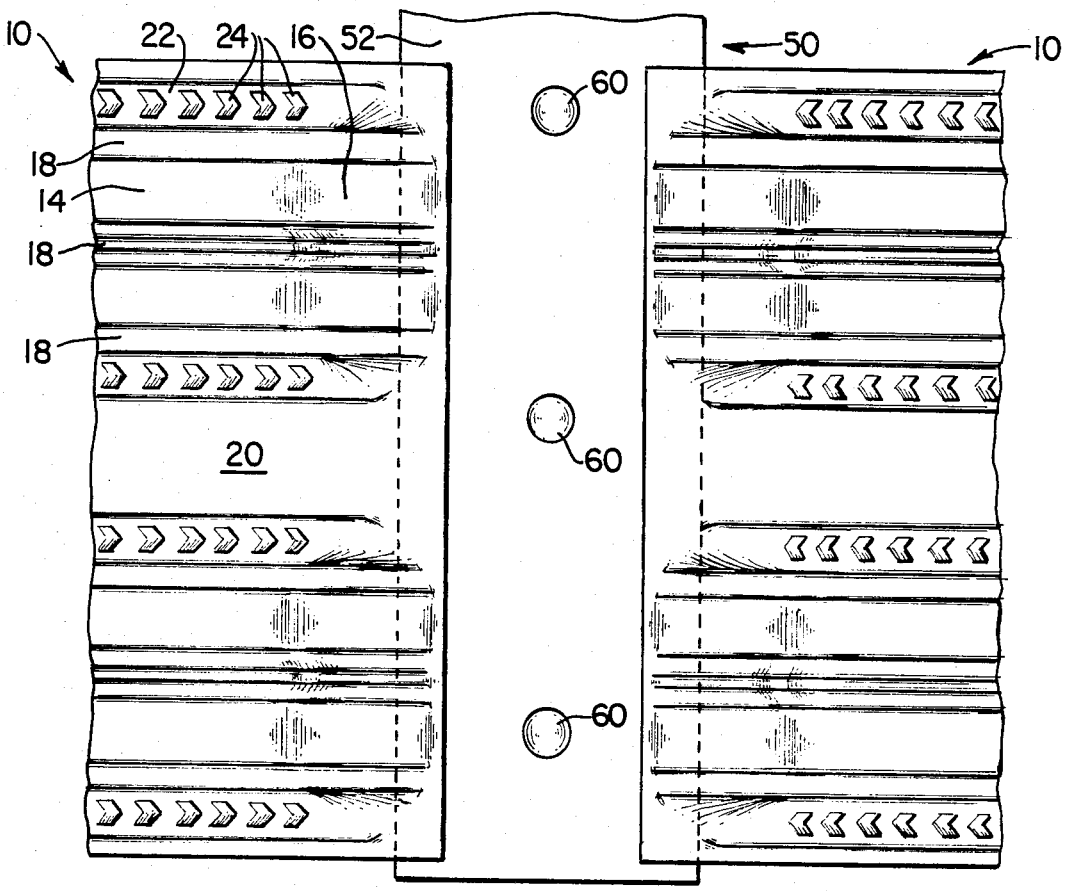
FIG. 4 is top plan view of a portion of the structure shown in FIG. 1.

I weld the studs 60 to the top member 52 of beam 50 at spaced intervals directly above the web member 56. This location on the beam not only provides a maximum shear transfer, but also allows for a sufficient volume of concrete 80 to surround each stud making the stud completely effective. The concrete haunch portion 81 of the concrete slab 80 effectively adds to the overall composite strength of the beam 50 and slab 80. This is shown most clearly in FIG. 2.

Figure 5:
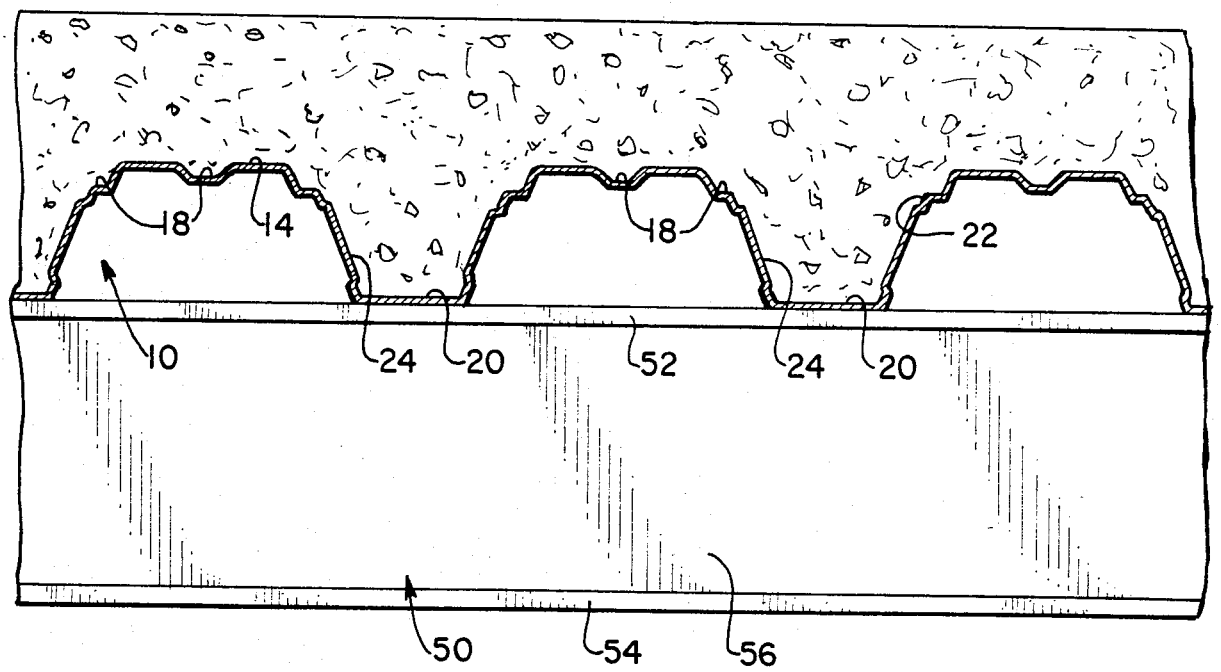
FIG. 5 is a cross-sectional view through A—A of FIG. 1 also showing the concrete slab.

Each sheet 10 has a plurality of longitudinally extended crest portions 14, valley portions 20 and intermediate webbing portions 22 oriented transversely with respect to I-beams 50. In order to provide an effective composite action between the corrugated sheet 10 and a concrete slab 80 (shown in FIG. 5) it is preferred to secure the sheet to the slab. Accordingly, I prefer to provide a plurality of embossments 24 on the webbing portions 22 of the sheet 10.

To provide an effective composite action between the beams 50 and the concrete slab 80, the beams must be secured to the slab. To avoid the necessity of indirectly welding the studs to the beam through the sheet, the sheets 10 must be terminated as they cross over the beams 50. Once the sheets are terminated, it is necessary to provide some type of covering means over the ends of the crest portions to prevent unwanted flow of concrete. I provide crests 14 having ends 16 which are an integral part of the sheet 10 and which preferably slope downwardly at a forty-five degree angle with respect to crests 14, thereby closing the crests 14 into cells. The crest portion 14, valley portion 20 and web portion 22 of each sheet 10 merge together at each end of the sheet to form rigid ends thereon. Further, as best shown in FIG. 1, each of these portions terminate in a substantially collinear relationship to form straight uninterrupted end edges on sheet 10. By providing sheets 10 having crests 14 with sloping end portions 16, the volume of concrete 80 that can surround the studs 60 is increased (best shown in FIG. 2), thereby increasing the effectiveness of the studs.

I also prefer to provide additional, shallow corrugations 18 in the crest portions 14 and crest end portions 16 of the sheets 10 to increase the overall rigidity of the sheet.

From the foregoing, it is clear that in order to provide a sufficient structure of concrete around the studs to make each stud completely effective, I prefer to combine the following features of my invention. First, I prefer to provide sheets having rigid ends to allow for adequate support while leaving a substantial portion of each beam exposed. Second, I prefer to weld the studs directly to the top surface of the beams directly over each beams' vertical web portion. Finally, I prefer to provide corrugated sheets having end portions which slope upwardly with respect to the top surface of the beams.

In operation, the high performance composite flooring structure I provide allows for a composite action between corrugated metal sheet and overlying concrete slab and also between the slab and the structure's supporting I-section beams. By providing a solid concrete haunch secured directly over each supporting I-beam the load carrying capacity of each beam is increased just as if a deeper I-beam had been used in the first instance. By also providing corrugated metal sheets secured under the concrete slab, the slab's flexibility and strength are likewise increased. Therefore, the entire flooring structure acts as a single composite unit having superior strength. Because of the structure's efficient design each stud is completely effective. To save on construction costs the studs may be welded to the beams at the factory rather than welded at the construction site. Finally, no time consuming ends need be attached to close the cells prior to the pouring of the concrete slab.

While I have illustrated and described certain present preferred embodiments of the invention and methods of practicing the same, it is to be understood that the invention is not limited thereto and may be variously practiced within the scope of the following claims.

I claim:

1. A composite floor structure comprising:

(a) a plurality of longitudinally extending spaced apart I-section supporting beams, each beam having a top member, base member and intermediate vertically oriented web member connecting said top and bottom members;

(b) a plurality of horizontally disposed corrugated sheets placed on the I-beams in a manner so that a substantial portion of the top member of each beam is exposed to allow for direct attachment of studs at any point near a longitudinal center line thereof and each sheet having longitudinally extending crest, valley and intermediate webbing portions oriented transversely with respect to the beams, the crest portions each having a body and two ends which ends each slope downwardly at an obtuse angle with respect to the body closing the ends of the crests, said crest, valley and intermediate portions merging together at each end of the sheet forming rigid end edges which terminate in a substantially collinear relationship;

(c) a plurality of studs welded to the exposed top portion of at least one of the beams at desired points near the center line thereof and directly over the vertical web portion of the beam; and (d) concrete covering the sheets and the exposed top portions of the beam and surrounding the studs.

2. A composite floor structure according to claim 1 wherein the webbing portions of the sheets have embossments thereon to secure the sheets to the layer of concrete.

3. A composite floor structure according to claim 1 wherein the ends of the crest portions of the sheets slope downwardly at substantially a one hundred and thirty-five degree angle.

4. A composite floor structure according to claim 1 wherein the crest portions of the sheets have additional corrugations therein to increase the stiffness of the sheets.

* * * * *